United States Patent [19]

Harmant

[11] 4,186,526

[45] Feb. 5, 1980

[54] HIGH-SENSITIVITY CONTROL-SYSTEM FOR IRONWORK GRINDERS

[75] Inventor: Michel Harmant, Neris-les-Bains, France

[73] Assignee: Etablissements Zelant, Gazuit, Societe Anonyme, Montlucon, France.

[21] Appl. No.: 865,872

[22] Filed: Dec. 30, 1977

[30] Foreign Application Priority Data

Jan. 7, 1977 [FR] France ..... 77 00344

[51] Int. Cl.[2] ..... B24B 49/08

[52] U.S. Cl. ..... 51/33 R; 51/165.9

[58] Field of Search ..... 51/47, 68, 99, 165.9, 51/33 R

[56] References Cited

U.S. PATENT DOCUMENTS

| | | | |
|---|---|---|---|
| 2,982,056 | 5/1961 | Edqvist | 51/99 X |
| 3,253,368 | 5/1966 | Vekovius | 51/47 X |
| 3,589,072 | 6/1971 | Burt | 51/45 |
| 3,798,843 | 3/1974 | Weatherell | 51/165.9 X |
| 4,020,598 | 5/1977 | Harmant | 51/34 R |

*Primary Examiner*—Gary L. Smith

[57] ABSTRACT

The bearing device consists of a hydraulic cylinder and piston unit mounted between two pivotally interconnected solids and a hydraulic circuit. The acceleration performances in the two directions imparted to the suspended mass supporting the grinding wheel are obtained by using a combination of suitable valve means controlling the hydraulic circuit and more particularly through the system for regulating the fluid pressure in one of the chambers of the cylinder which operates as a differential. The result thus obtained is a homogeneous removal of chips and an optimal exploitation of energying flaw-removing machines.

2 Claims, 5 Drawing Figures

HIGH-SENSITIVITY CONTROL-SYSTEM FOR IRONWORK GRINDERS

BACKGROUND OF THE INVENTION

The present invention relates in general to grinders of the type utilized for removing flaws, cracks and splits from metallurgical products, and has specific reference to improved means for controlling the working pressure and the movements of grinding wheels.

It is known that to remove metal from a product by means of the peripheral surface of a circular grinding tool or wheel, a certain torque must be exerted in a direction parallel to the axis of the grinding wheel, together with a pressure directed at right angles to this axis. Moreover, some means must be provided to keep the axis of the grinding wheel constantly parallel to itself during the grinding operation. The feed, that is, the work progression, consists in general in causing the surface to be ground to move in any direction but in a plane parallel to the axis of the grinding wheel.

As a rule, grinding wheels are mounted on spindles rotating at relatively high speed. The spindle of course is caused to transmit all the mechanical efforts imparted thereto by the grinding wheel during its operation.

Various means have already been proposed for exerting the rotational torque and regulating the speed. A typical arrangement of this type is disclosed in U.S. Pat. No. 4,020,598.

With this system a playless assembly can be obtained, since the pivots are provided with prestressed bearings.

BRIEF SUMMARY OF THE INVENTION

The present invention is characterized in that the device for controlling the grinding pressure of the grinding wheel comprises means for controlling the bearing pressure of the grinding wheel on the surface differentially by means of a hydraulic circuit which keeps the pressure in one of the chambers of the cylinder-piston unit controlling the movement of the grinding wheel holder fixed and adjustable in the other chamber.

BRIEF DESCRIPTION OF THE DRAWINGS

The invention is illustrated by way of example in the accompanying drawings, in which.

Figure 1:
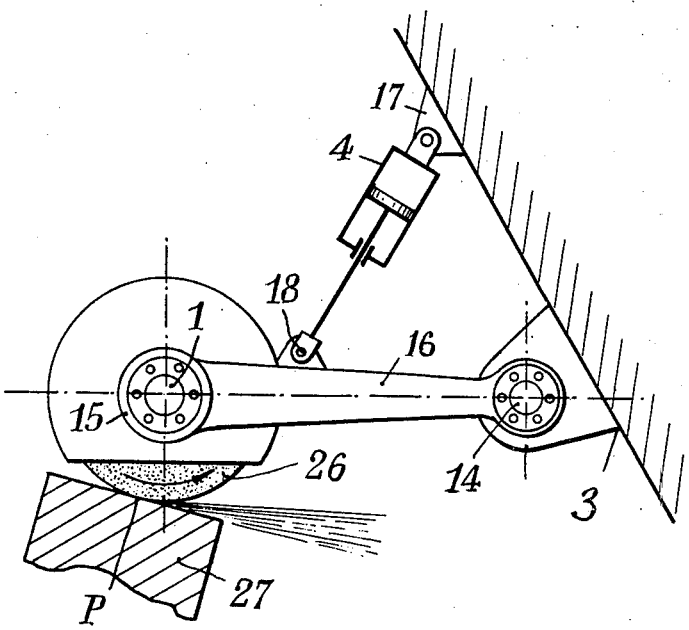
FIG. 1 is a side view of a grinding apparatus.
Figure 2:
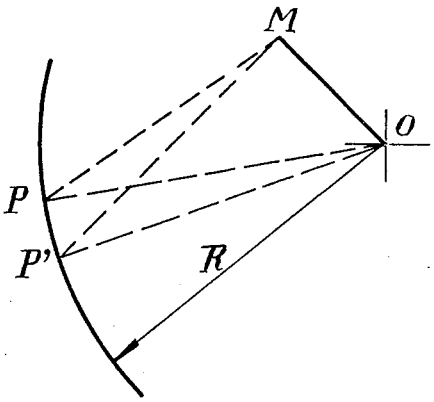
FIG. 2 is a diagram for illustrating the movement of part of the grinding apparatus of FIG. 1.

The mechanism illustrated in FIG. 1 of the accompanying drawing comprises essentially a grinding wheel spindle or shaft 1 mounted in a sleeve 15 rigid with a pivotally mounted arm 16 comprising in turn, at its opposite end, a playless pivotal mounting 14 so that the arm can pivot about a fixed center. This fixed center is carried by a bracket or similar body 3 consisting for example of a fixed frame or a pivotally mounted member permitting the generation of other movements. One of these other movements is shown in FIG. 2.

The same body 3 comprises a pivotal connection 17 for one end of a hydraulic cylinder and piston unit 4 having its opposite or piston rod end pivotally connected via another pin 18 to the grinding wheel carrier arm 16. This mechanism, when seen in elevational view, constitutes a deformable triangle having two constant sides and a variable side.

The dimensions of the sides of triangle OPM (see FIG. 2) are so selected that at point P the movement of the grinding wheel (by means not shown) engaging the workpiece or product to be ground can be assimilated to a rectilinear movement (having a relatively long radius R in comparison with the arc PP', these points P, P' correspond to the endmost positions of the permissible movement of point P for a given grinding operation). The same dimensional choice makes it possible to determine that the working pressure exerted through the cylinder and piston unit 4 produces a constant effort normally to the surface of the product P to be ground.

The products or articles to be ground consist as a rule of semi-finished metallurgical products of iron, such as ingots, blooms, slabs, billets, round pieces, octogonal prisms, hexagonal prisms, etc.

All these products display considerable geometrical irregularities or unevenness.

It is the main purpose of the grinding operation to remove surface defects or flaws without modifying the geometrical shape of the product. Therefore, the flaws must be removed by using a substantially constant depth of pass. Now the section of the product which lies in the plane of FIG. 1 varies, due to the geometrical irregularity of the product, when the latter is moved in a direction at right angles to the plane of the Figure, for instance.

DESCRIPTION OF THE INVENTION

The present invention provides a particularly efficient means for maintaining at a constant value the contact effort between the grinding wheel and the product while permitting the movement of the contact point in space.

The system described hereinabove, when associated with the mechanism illustrated by way of example (deformable triangle), provides a perfectly constant depth of pass. This is extremely advantageous and valuable in the metallurgy of iron. Moreover, it permits of controlling and adjusting with a high degree of precision and a high sensitivity the contact effort necessary for obtaining a predetermined depth of pass.

With this arrangement it is possible, inter alia, to control with precision the sufficient amount of metal to be removed for obtaining sound products and make the grinding operation economically advantageous.

Finally, the device according to the present invention constitutes a real must for performing grinding operations under constant power conditions. This constant power characteristic is much sought after by actual users concerned with the possibility of combining high productivity with the best possible coefficient of power consumption in their plant.

The present invention consists in selecting an electro-hydraulic control and subservience device capable of producing the selected static and dynamic states of equilibrium as well as the desired high sensitivity.

Figure 3:
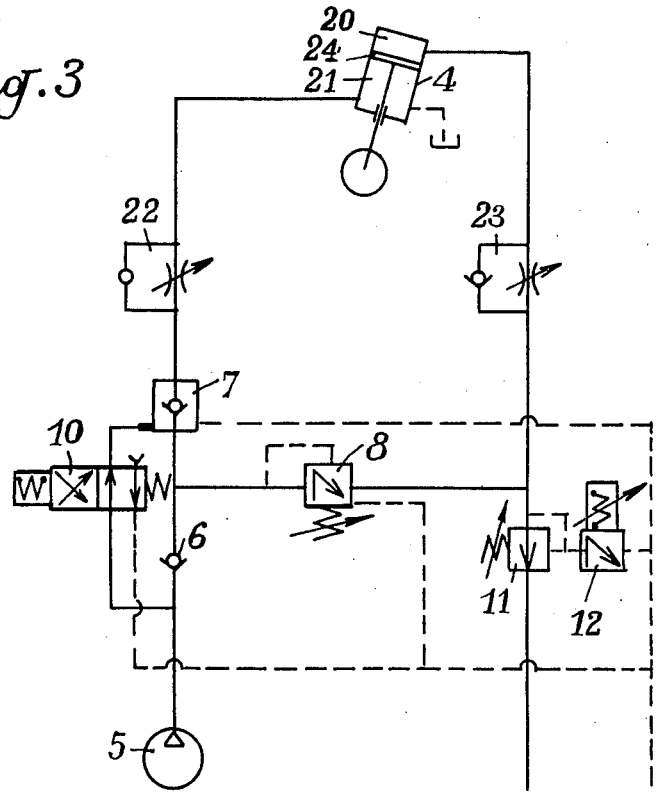
FIG. 3 is a hydraulic circuit diagram for use in the grinding apparatus according to FIG. 1.

The principle of the hydraulic circuit controlling the cylinder and piston unit 4 is illustrated in FIG. 3. To facilitate the understanding, this diagram comprises only the main component elements of the circuit.

The circuit energy is transmitted from a hydraulic pump 5 feeding a pair of chambers 20 and 21 of cylinder 4 via non-return valves 6 and 7, pressure limiting valve 8 and output-limiting throttling valves 22 and 23.

The circuit is completed by a two-way distributor 10 monitoring the differential valve 7.

The monitoring of valve 7 by distributor 10 ensures the instantaneous opening and closing of the fluid passage between chamber 21 of cylinder 4 and the other branches of the circuit (to lock the piston).

Finally, pressure adjustment is obtained by means of a set of valves 11 and 12.

Valve 11 is a pressure-regulating sequential valve, and valve 12 is an electro-hydraulic valve for monitoring valve 11.

The electro-hydraulic valve 12 is selected on account of its high sensitivity to variations and also of its high precision (very low hysteresis). The power member of this valve 12 is a solenoid receiving an electric signal comprising a continuous component and a modulated component.

The continuous component sets a plunger core coaxial to the solenoid in a well-defined position. This plunger core actuates a valve controlling a pressure by calibrating the hydraulic escapement thus created. Under normal operating conditions (i.e. adequate thermal stability of the hydraulic fluid) the same continuous component of the signal always generates the same hydraulic pressure value in the upper chamber 20 of the hydraulic cylinder and piston unit.

The modulated component of the signal applied to the solenoid imparts a considerable mobility to the plunger core, thus eliminating internal friction effects. This modulated component has a zero average electric value and plays no role with respect to the plunger core position and therefore to the pressure.

Valve 8 is adapted to set the pressure value in the circuit connected to the lower chamber 21 of cylinder 4. This value is preset mechanically and remains constant throughout the operation of the device.

Therefore, the cylinder and piston unit 4 operates as a differential. The pressure regulation in chamber 20 affords at any time a predetermined static equilibrium of the piston in cylinder 4 and consequently the desired bearing pressure.

In addition to a very high stability, this circuit is advantageous in that is causes the cylinder and piston unit to react very rapidly. This feature is due primarily to the differential effort providing optimal fluid transfers in case of variations, without requiring excessive output values.

The throttling valves 22 and 23 act as damping devices in the circuit. The maximum fluid transfer speed between the two chambers of cylinder 4 is determined by the degree of opening of these valves 22 and 23. Consequently, the sensitiveness of the device is adjustable as a function of the free opening of said throttling valves 22 and 23.

A maximum opening affords the highest sensitivity of the piston movement.

A typical example of the manner of calculating the component elements of the device of this invention will now be given to illustrate with precision the mode of operation. This calculation is based on a pratical embodiment so as to provide representative figures of the actual performance of the device.

It is comtemplated to figure out the dynamic sensitiveness of the device, i.e. to demonstrate the capacity of piston 24 to move very rapidly in cylinder 4 without any variation in the effort transmitted by said piston along its axis.

The sensitivity performance is subordinate to the vis inertiae generated by the suspended mass and to the dynamic properties of piston 24 under the conditions shown in the diagram of FIG. 3.

Figure 4:
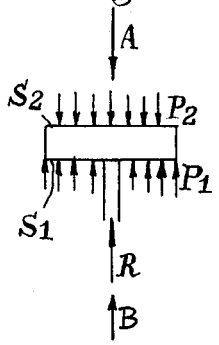
FIG. 4 illustrates the forces exerted on the piston of the grinding apparatus of FIG. 1.

The piston static equilibrium (see FIG. 4) is given by the following equation:

$A = R + B$ wherein

A is the effect of hydraulic pressure on the upper face $S_2$ of piston 24,

R is the vertical reaction to the working effort (in this case the grinding effort), and B is the action of the hydraulic pressure on the lower face $S_1$ of piston 24.

This equation may be written as follows:

$P_2S_2 = R + P_1S_1$.

In the specific case contemplated herein, the suspended mass comprises the grinding wheel spindle 1 with the protection case and the wheel proper, the carrier arm 16 with its bearing sleeves and pivot means, and the piston and piston-rod assembly 24.

This mass may correspond for example to 1,100 kilograms.

The dynamic equilibrium of the piston is obtained as follows:

during the upward movement thereof:

The static equilibrium is upset by an unevenness (boss) on the product, which increases the vertical grinding reaction.

In this case, and considering the forces involved, it is necessary to accelerate the suspended mass from zero speed to the maximum linear speed of piston 24.

It is also necessary to accelerate the fluid masses contained in the circuits:

in a state of equilibrium, the entire pump output is caused to flow through the drain of valve 8.

To produce an upward movement of piston 24, the fluid column contained in the pipes between valve 8 and cylinder 4 must also be accelerated. Since its mass averages only 3 kilograms, it can be disregarded in the calculation.

Calculation

Assuming that:

the piston surface on the cylinder bottom side is 70.7 sq.cm. ($S_2$),

The piston surface on the rod side is 37.6 sq.cm ($S_1$),

The maximum permissible output in the "bottom" circuit (through valve 11) is 115 liters/min, The maximum permissible output in the hydraulic circuit on the rod side is 42 liters/min, The maximum piston speed in the upward direction is that corresponding to the most critical output, i.e. 0.27 m/s on the bottom side and 0.19 m/s on the rod side, we have:

$Vc_1 = 0.19$ m/s

The time elapsing until this maximum speed is attained corresponds to the response time of valve 11 (in the opening direction) which corresponds also to the closing of valve 8.

This time, determined by experiment is 18 milliseconds $= \Delta_T 18 \times 10^{-3}$.

Hence the theoretical piston acceleration:

$$\Delta Vc_1/\Delta t = (0.19/18 \times 10^{-3} \approx /10 \text{ m/s}^2$$

(This is a 'by default'value, since valve 11 is not open completely, whereas time 18 m/s corresponds to the complete opening stroke).

This acceleration corresponds to a resultant dynamic force exerted on the piston, amounting to:

Force = mass × acceleration.

mass (as described above) is 1,100 kilograms acceleration is 10 $m/s^2$ thus, exerted force onto the piston is:

$F = 1{,}100 \times 10 = 11{,}000$ Newton or 1,100 daN actually corresponding to the static capacities of the control circuit.

The importance of the "suspended mass" factor is emphasized herein. In the present example this mass corresponds to 1,100 kilograms. For a given hydraulic circuit operating under constant pressure the gage of the apparatus (cylinder and piston units, pumps, etc.) is directly proportional to the value of this suspended mass.

Exactly when the acceleration begins, it is assumed that pressure $P_1$ is reduced to zero; thus, pressure $P_2$ must decrease abruptly by the value corresponding to the instantaneous restoration of the static equilibrium, i.e.:

$\Delta(P_2S_2) = \Delta(P_1S_1)$ $\Delta P_2 = S_1/S_2 \Delta P_1 = 0.53 \times 120$ $\Delta P_2 = 63.5$ bars.

It is known that the solenoid valve 12 has a dynamic property such that any disturbance in its displayed equilibrium follows a variation curve of which the average slope is 23 bars/millisecond.

Therefore, the equilibrium will be restored within a time $\Delta P_2/23 = 63.5/23 = 2.8$ ms.

Dynamic equilibrium during the downward movement of the piston

The static equilibrium is upset by the absence of any vertical reaction during the grinding operation (depression).

The same suspended mass is to be accelerated from zero speed to a maximal speed corresponding to the critical output on the bottom side of the piston.

Critical output volume:

$42{,}000 + 37.6 \times \mathbf{Vc_2} = 70.7\ Vc_2$ (pump output)

$Vc_2 = (42{,}000/70.7 - 37.6) = 1{,}269$ cm/mn $= 0.21$ m/s $Vc_2$ = critical piston velocity in the upward direction.

This velocity may be reached within the response time of valve 8, which is 18 m/s hence the theoretical acceleration $= 0.21/0.018 = 11.7\ m/s^2$.

Checking

The dynamic characteristic during the pressure increment is 6.4 bars/millisecond.

The force of unbalance, or equilibrium upsetting force, is at the most equal to the maximal bearing force, i.e. 1,000 daN, corresponding to a $\Delta P_2$ of 14 bars.

The state of equilibrium will be restored within $14/6.4 = 2.2$ ms/

Length of the ground trace corresponding to a bearing disturbance as a consequence of a vertical pressure exerted against the grinding wheel.

In the foregoing, the maximal piston acceleration was 10 $m/s^2$.

The maximal acceleration of the tangential point of the grinding wheel will be $2 \times 10\ m/s^2 = 20\ m/s^2$ (by similarity due to the lever arm).

The maximum vertical velocity is $2 \times 0.2 = 0.4$ m/s.

Given a bed velocity of 90 m/mn (i.e. 1.5 m/s) the critical slope of the surface defects of the product is that corresponding to a velocity-vector resulting from the two components 0.4 m/s and 1.5 m/s, that is, a slope of:

$0.4/1.5 = 0.267$ (or an angle of about 15°).

The mean value of the critical velocities is 0.19 m/s upwardly, and 0.21 m/s downwardly.

Figure 5:
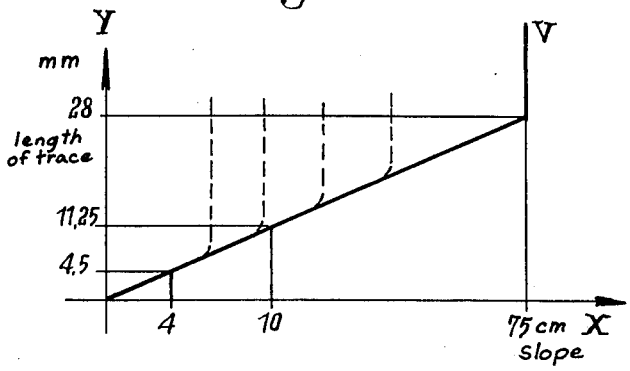
FIG. 5 is a diagram illustrating the efficiency of the grinding apparatus according to the present invention.

The conclusion of this calculation may be reproduced on a diagram in order to evidence the efficiency of the device (FIG. 5).

In this diagram the slope (in cm) is plotted in abscissa and corresponds to the variation in level of the product moving under the grinding wheel (projection or depression). The length of the trace Y measured in mm along the feed movement of the product is plotted in ordinates, this length corresponding to the path during which the bearing pressure is modified with respect to the displayed rated pressure.

If the standard width of a grinding wheel is 3" (76 mm), it is clear that no appreciable disturbance can be observed during the grinding operation as a consequence of the passage on the aforesaid variations in level.

The critical values obtained at different throttle valve openings during actual operation are shown in dash lines and V denotes the theoretical value corresponding to the maximal opening of said throttle valves.

Consequently, it can be asserted that the device is capable of performing its function consisting in maintaining a constant bearing pressure and therefore a perfectly uniform removal of chips from the surface of the product.

It will readily occur to those conversant with the art that various modifications and changes may be brought to the practical embodiments of the present invention without departing from the basic principles thereof.

What is claimed as new is:

1. A device for controlling the grinding pressure of a grinding wheel for grinding a surface of a product, comprising: a support, an arm pivotally suspended from said support substantially free of play, a grinding wheel rotatably supported at the free end of said arm, a mechanism for transmitting rotational movement to said wheel, a cylinder-piston unit having a cylinder, a piston in said cylinder and two chambers on opposite sides of said piston, said cylinder-piston unit being pivotally connected to said arm at a point along the length of the arm and also being pivotally connected to said support at a point forming with said point on said arm and the pivotal connection of said arm to said support a triangle, and means for controlling the bearing pressure of the grinding wheel on the surface, said means including means for establishing a differential pressure between said two chambers, a feed pump for said cylinder-piston unit, a hydraulic circuit connected to said pump for supplying pressure to said chambers of said cylinder-piston unit, said hydraulic circuit having a first branch leading to one of said chambers and a second branch leading to the other chamber, one of said branches comprising regulating valves, a pressure limiting valve and a flow limiting choke valve, and the other branch comprising a two-piston distributor, a differential valve, a flow limiting choke valve, a pressure regulating sequential valve and an electrohydraulic valve for operating said pressure regulating sequential valve.

2. A device according to claim 1, wherein said means for establishing a differential pressure comprises means for keeping the pressure in one of said chambers fixed and the pressure in the other chamber adjustable.

* * * * *